United States Patent [19]

Peels et al.

[11] Patent Number: 4,620,134

[45] Date of Patent: Oct. 28, 1986

[54] CATHODE-RAY TUBE

[75] Inventors: Antonius H. P. M. Peels; Antonius J. M. van den Beld; Jan Bijma; Jan Gerritsen, all of Eindhoven, Netherlands

[73] Assignee: U.S. Philips Corporation, New York, N.Y.

[21] Appl. No.: 544,169

[22] Filed: Oct. 21, 1983

[30] Foreign Application Priority Data

Oct. 29, 1982 [NL] Netherlands ..... 8204185

[51] Int. Cl.[4] ..... H01J 29/46; H01J 29/56

[52] U.S. Cl. ..... 315/15; 313/414; 313/449

[58] Field of Search ..... 315/14, 15; 313/414, 313/449

[56] References Cited

U.S. PATENT DOCUMENTS

| | | | |
|---|---|---|---|
| 3,437,868 | 4/1969 | Ohkoshi et al. | 315/15 |
| 4,287,450 | 9/1981 | Kawakami et al. | 315/14 |
| 4,481,445 | 11/1984 | Gorski | 315/14 |
| 4,496,877 | 1/1985 | Kueny | 315/15 |

*Primary Examiner*—Theodore M. Blum
*Attorney, Agent, or Firm*—Robert J. Kraus

[57] ABSTRACT

The spot quality of an electron beam produced by an electron gun in a cathode ray tube is improved by optimizing the dimensions of a beam-forming, apertured electrode arrangement in the gun. This arrangement includes electrodes for forming a cross-over followed by, in the direction of propagation of the electron beam, first and second lens electrodes centered around an axis, for defining an accelerating and prefocusing lens and at least two lens electrodes for defining a main focusing lens. The diameter of the aperture in the second lens electrode is smaller than twice the diameter of the aperture in the first lens electrode, and the effective spacing S-eff between the first and the second lens electrodes is smaller than 1 mm. S-eff is defined as the minimum of the function $$-\frac{\Delta V}{E(z)},$$

where $\Delta V$ is the operating voltage difference between the second and first lens electrodes and $E(z)$ is the operating electrical field strength between the first and second lens electrodes on the beam (z) axis as a function of the place z on the axis.

5 Claims, 13 Drawing Figures

CATHODE-RAY TUBE

BACKGROUND OF THE INVENTION

The invention relates to a cathode-ray tube comprising in an evacuated envelope means to generate at least one electron beam and to form a cross-over behind which, viewed in the direction of propagation of the electron beam, are provided successively an accelerating pre-focusing lens comprising a first and second lens electrode centred around an axis, and a main focusing lens comprising at least two electrodes. The cathode-ray tube includes means to apply electric voltages to the lens electrode.

Such a cathode ray tube can be used for displaying monochromatic or multicolour pictures, for example television pictures. In that case the cathode-ray tube is a display tube comprising a display screen. Such a cathode-ray tube, however, may also be used to record pictures. In that case the cathode-ray tube is a camera tube having a photosensitive, for example photoconductive, layer.

The means to generate an electron beam and to form a cross-over are usually formed by a triode consisting of a cathode, a control grid and an anode. However, it is also possible to generate an electron beam by means of a semiconductor device as described in Netherlands Patent Application No. 7 905 470, corresponding to U.S. Pat. No. 4,303,930, and to focus it to form a cross-over.

A cathode-ray tube of the kind described in the opening paragraph is known from the Netherlands Patent Application No. 7 902 868, corresponding to U.S. Pat. No. 4,318,027. The cathode-ray tube described in the latter Application comprises a cathode, a control grid, a first lens electrode (termed G-2 in the Application) and a second lens electrode (termed G-3 in the Patent Application). The cathode, control grid and first lens electrode ensure the generation of an electron beam which is focused into a cross-over in the proximity of the first lens electrode. The cross-over is focused onto the display screen of the cathode-ray tube by means of one or more focusing lenses. The spot displayed on the display screen must have a good quality. This means that the spot must have small dimensions and be surrounded by as little haze as possible. According to the published Netherlands Patent Application No. 7 902 868 a spot having a better quality is obtained by using a comparatively thick first lens electrode and by ensuring that a strong flat electric field is present between the first and second lens electrode and/or the main focusing lens has a larger object distance than usual. According to the Patent Application the pre-focusing of the electron beam by the first accelerating focusing lens is preferably eliminated or is at least strongly reduced after the cross-over. Nevertheless, the improvements described do not lead to an optimum result.

SUMMARY OF THE INVENTION

It is therefore an object of the invention to provide a cathode ray tube with which the spot quality is improved.

For that purpose, according to the invention a cathode-ray tube of the kind mentioned in the opening paragraph is characterized in that the diameter of the aperture in the second lens electrode is smaller than twice the diameter of the aperture in the first lens electrode and the effective spacing S-eff between the first and the second lens electrode is smaller than 1 mm, S-eff being defined as the minimum of the function $$-\frac{\Delta V}{E(z)},$$

where $\Delta V$ is the voltage difference between the second and first lens electrodes and $E(z)$ is the electrical field strength between the first and second lens electrodes on the axis as a function of the place z on the axis.

The invention is based on the recognition of the fact that an electric field variation must be created between the first and second lens electrodes such that the edge rays of the generated electron beam immediately after the cross-over are bent inwardly further than the remaining rays, such that they are located inside the electron beam when they reach the main focusing lens. The result of this is that the spherical aberration of the main focusing lens acts upon other rays than the spherical aberration of the pre-focusing lens. As a result of this, the total spherical aberration of the whole electron gun system is divided over more rays of the electron beam, as a result of which a decrease of the effect of the spherical aberration in the spot is obtained. Consequently, with beam currents remaining the same, the spot becomes smaller and is surrounded by less haze than in the electron guns used so far. The variation of the electrical field between the first and the second lens electrode is determined by the spacing between the electrodes, the dimensions of the apertures in the electrodes and the operating potentials of the electrodes. The edge rays in the pre-focusing lens are bent sufficiently inward when the diameter of the aperture in the second lens electrode is smaller than twice the diameter of the aperture in the first lens electrode and the effective spacing S-eff between the first and second lens electrodes is smaller than 1 mm, as was already indicated. The electrical field on the axis between the two lens electrodes is fixed by the first derivative to the place z of the potential variation along the axis, hence $$E(z) = -\frac{d\,V(z)}{d\,z}$$

The potential variation along the axis with given gun dimensions and given potentials on the electrodes can be measured and/or computed. The spacing between the first and the second lens electrode is preferably smaller than 0.8 mm. The lower limit of this spacing is determined by the potentials or the electrodes and the electrode form, for example, the presence or absence of sharp edges. The spacing may not be chosen to be too small, for example smaller than 0.2 mm, because in that case electrical breakdown may occur.

Cathode-ray tubes in accordance with the invention having a very good spot quality are obtained if the diameter of the aperture in the first lens electrode is smaller than 0.9 mm and the diameter of the aperture in the second lens electrode is smaller than 1.6 mm, or if the diameter of the aperture in the second lens electrode is equal to or substantially equal to the diameter of the aperture in the first lens electrode. If the spacing between the first and the second lens electrodes is equal to or approximately equal to 0.4 mm, the possibility of the occurrence of electrical breakdowns is negligibly small.

BRIEF DESCRIPTION OF THE DRAWING

The invention will now be described in greater detail, by way of example, with reference to a drawing, in which.

DESCRIPTION OF THE PREFERRED EMBODIMENT

Figure 1:
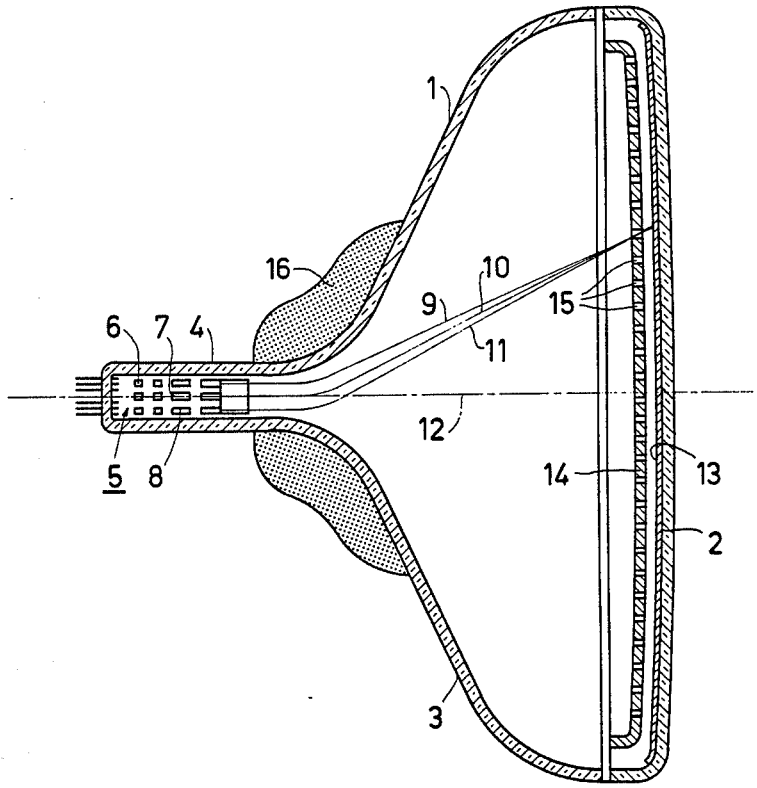
FIG. 1 is a horizontal longitudinal sectional view through a cathode-ray tube according to the invention.

FIG. 1 is a horizontal longitudinal sectional view of a cathode-ray tube for displaying coloured television pictures, hereinafter termed a colour display tube. Provided in the neck of a glass envelope 1, which is composed of a display window 2, a cone 3 and the neck 4, is an electron gun system 5 which generates three electron beams 9, 10 and 11 situated with their axes in one plane (the plane of the drawing) by means of three electron guns 6, 7 and 8. The axis of the central electron gun 7 coincides with the tube axis 12. The display window 2 comprises on its inside a great number of triplets of phosphor lines. Each triplet comprises a line consisting of a blue-luminescing phosphor, a line consisting of a green-luminescing phosphor, and a line consisting of a red-luminescing phosphor. All triplets together constitute the display screen 13. The phosphor lines are substantially perpendicular to the plane of the drawing. Positioned in front of the display screen 13 is a shadow mask 14 in which a very great number of elongate apertures 15 are provided through which the electron beams 9, 10 and 11 pass which each impinge only upon phosphor lines of one colour. The three electron beams situated in one plane are deflected by the system of deflection coils 16. The electron gun system 5 of the colour display tube consists in this case of three individual electron guns 6, 7 and 8. However, it is also possible to use the invention in a so-called integrated electron gun system, as described, for example, in the already mentioned published Netherlands Patent Application No. 7 902 868, in which the electron guns have a number of electrodes in common. The invention may also be used in colour display tubes in which phosphor dots are used instead of phosphor lines and also in monochromatic cathode-ray display tubes and in camera tubes.

Figure 2:
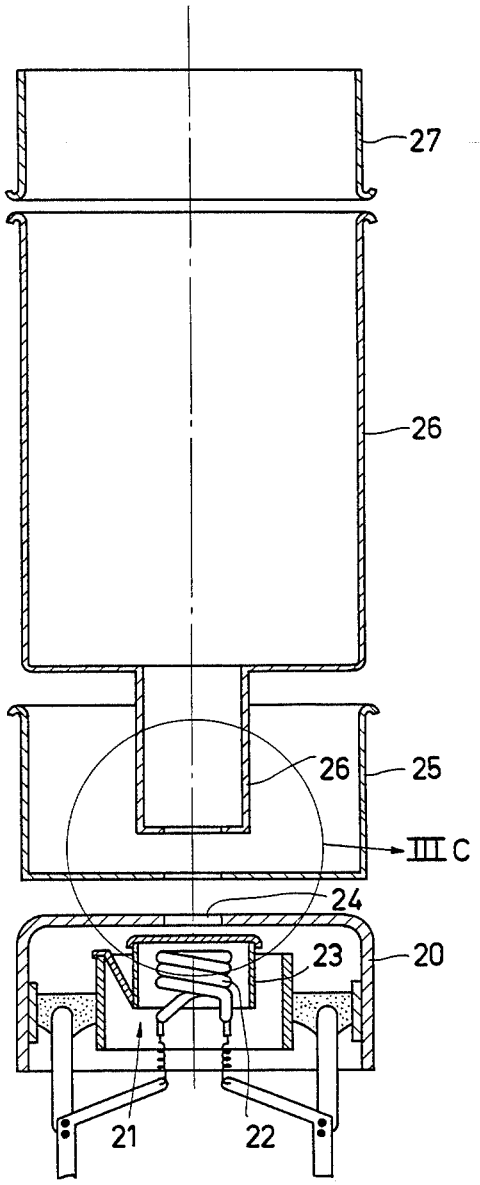
FIG. 2 is a longitudinal sectional view through one of the electron guns as used in the cathode-ray tube shown in FIG. 1, FIGS. 3*a* to 3*d* show details of a diagrammatic longitudinal sectional view of a number of electron guns.

FIG. 2 is a longitudinal sectional view through one of the electron guns as used in the cathode-ray tube shown in FIG. 1. In the control grid 20 is a cathode 21 having a heater element 22 in a cathode shaft 23, which shaft has an emissive surface opposite to the aperture 24 in the control grid 20. The cathode is suspended in the control grid so as to be insulated. The anode which is also the first lens electrode 25 produces, together with the second lens electrode 26, a pre-focusing lens in the operating display tube. The lens electrodes 26 and 27 together constitute the main focusing lens. Main focusing lenses consisting of more electrodes are also known. Such main electrode lenses can also be used in a cathode-ray tube in accordance with the invention.

The invention may also be used in electron guns in which the beam is deflected near the cross-over, as is the case, for example, in U.S. Pat. No. 4,291,251 or in electron guns in which the beam is deflected in the main focusing lens.

FIGS. 3*a* to *d* show diagrammatically a detail of a longitudinal sectional view of a number of electron guns including the gun shown in FIG. 2. The sectional views of the electrodes are shown only on one side of the Z axis. The location and the dimensions of the cathode 30, the control grid 31 and the first lens electrode 32, which is also the anode, are the same in all four figures 3*a* to 3*d*. The dimensions can be read from the scale division along the Z axis and the R axis. The voltages in Volts at the various electrodes are also shown.

Figure 3A:
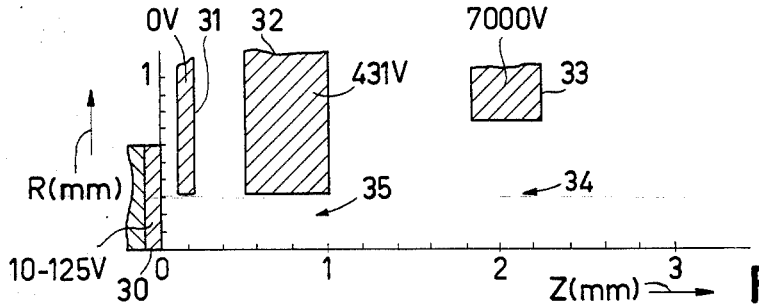
FIG.3a PRIOR ART

FIG. 3*a* is a detail of a sectional view of an electron gun in which the second lens electrode 33 comprises an aperture 34 having a diameter of 1.50 mm. The diameter of the aperture 35 in electrode 32 is 0.65 mm. The spacing between the first lens electrode 32 and the second lens electrode 33 is 0.8 mm. This electron gun corresponds approximately to an electron gun described in the published Netherlands Patent Application No. 7 902 868.

Figure 3B:
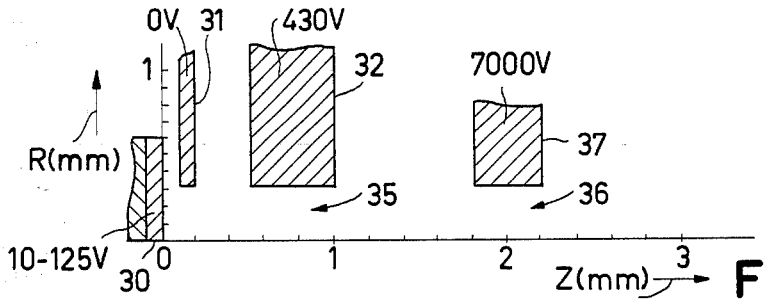

FIG. 3*b* is a detail of a sectional view of an electron gun which is similar to the electron gun of FIG. 3*a*. The difference is that the diameter of aperture 36 in the second lens electrode 37 is considerably smaller and is 0.65 mm.

Figure 3C:
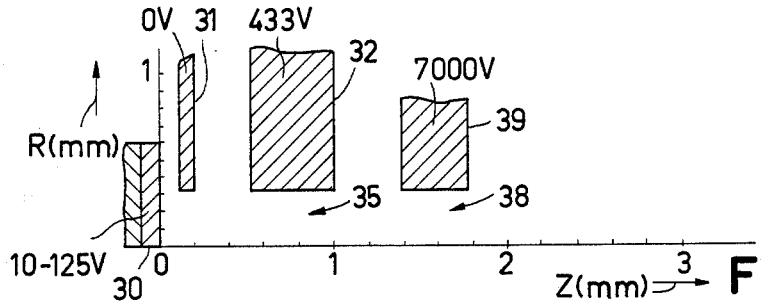

FIG. 3*c* is a detail of a sectional view of an electron gun in which the diameter of the aperture 38 in the second lens electrode 39 is the same as the diameter of the aperture 36 in FIG. 3*b*, the spacing between the first lens electrode 32 and the second lens electrode 39 is only 0.4 mm.

Figure 3D:
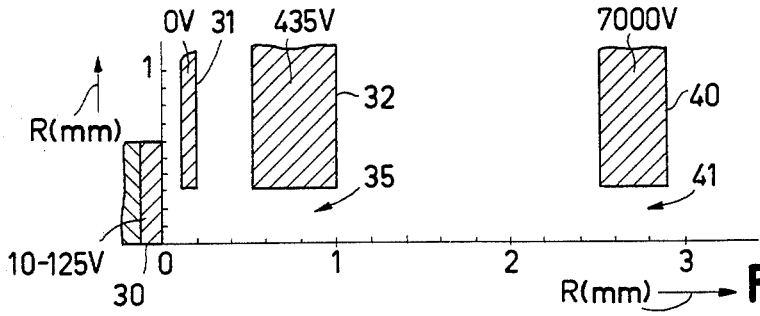

FIG. 3*d* is a detail of a sectional view of an electron gun in which an aperture 41 also having a diameter of 0.65 mm is provided in the second lens electrode 40, but the distance to the first lens electrode (32) is 1.5 mm.

Figure 4:
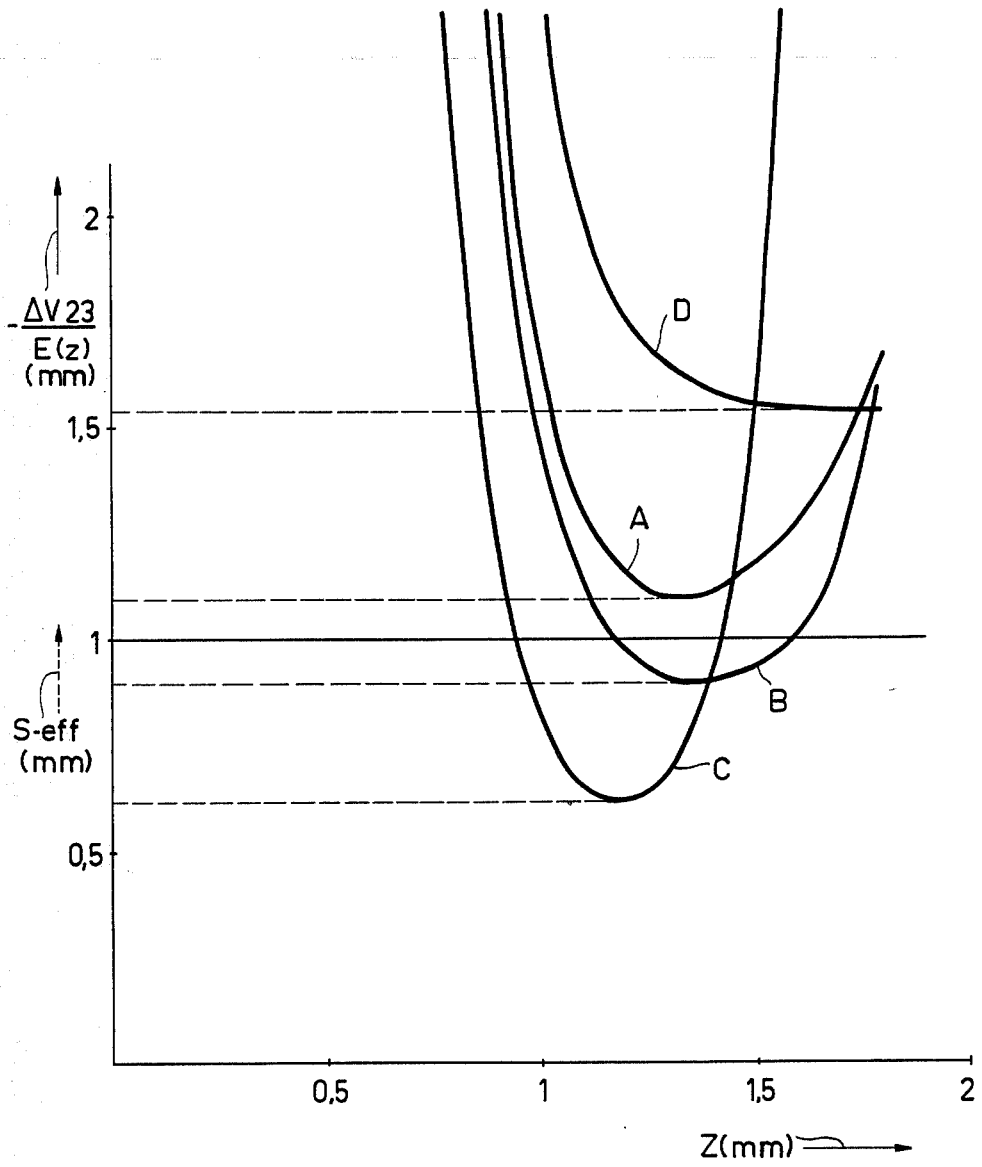
FIG. 4 shows the variation of the function $-\Delta/E(z)$ for the electron guns as shown in FIGS. 3*a* to 3*d*, FIGS. 5 and 6 again show details according to FIGS. 3*a* and 3*c*, respectively, showing a number of rays (electron paths) of the electron beam and a number of equipotential lines.

FIG. 4 shows the function $-\Delta V/E(z)$ in the curves A to D, for the situations shown in FIGS. 3*a* to 3*d*, respectively. The minimum of each function represents an effective spacing, S-eff. This depends on the electrode dimensions and the locations of the lens electrodes. It has been found in practice that the diameter of the aperture in the second lens electrode must be smaller than twice the diameter of the aperture in the first lens electrode and the effective spacing S-eff must be smaller than 1 mm. In that case the edge rays of the electron beam immediately after the cross-over are bent inwardly considerably more than the remaining rays. The broken lines indicate the value of S-eff, the effective spacing, for the situations shown in FIGS. 3*a* to 3*d*.

FIG. 5 again shows the detail of FIG. 3*a* but this time with a number of computed rays 50 (electron paths) of the electron beam. Moreover, a number of equipotential lines 51 are shown.

FIG. 6 again shows the detail of the longitudinal sectional view of FIG. 3*c* with a number of computed rays 60 (electron paths) of the electron beam and with a number of equipotential lines 61. Both in FIG. 5 and in FIG. 6, adjoining parts of the electron beam are shown one below the other.

Figure 5:
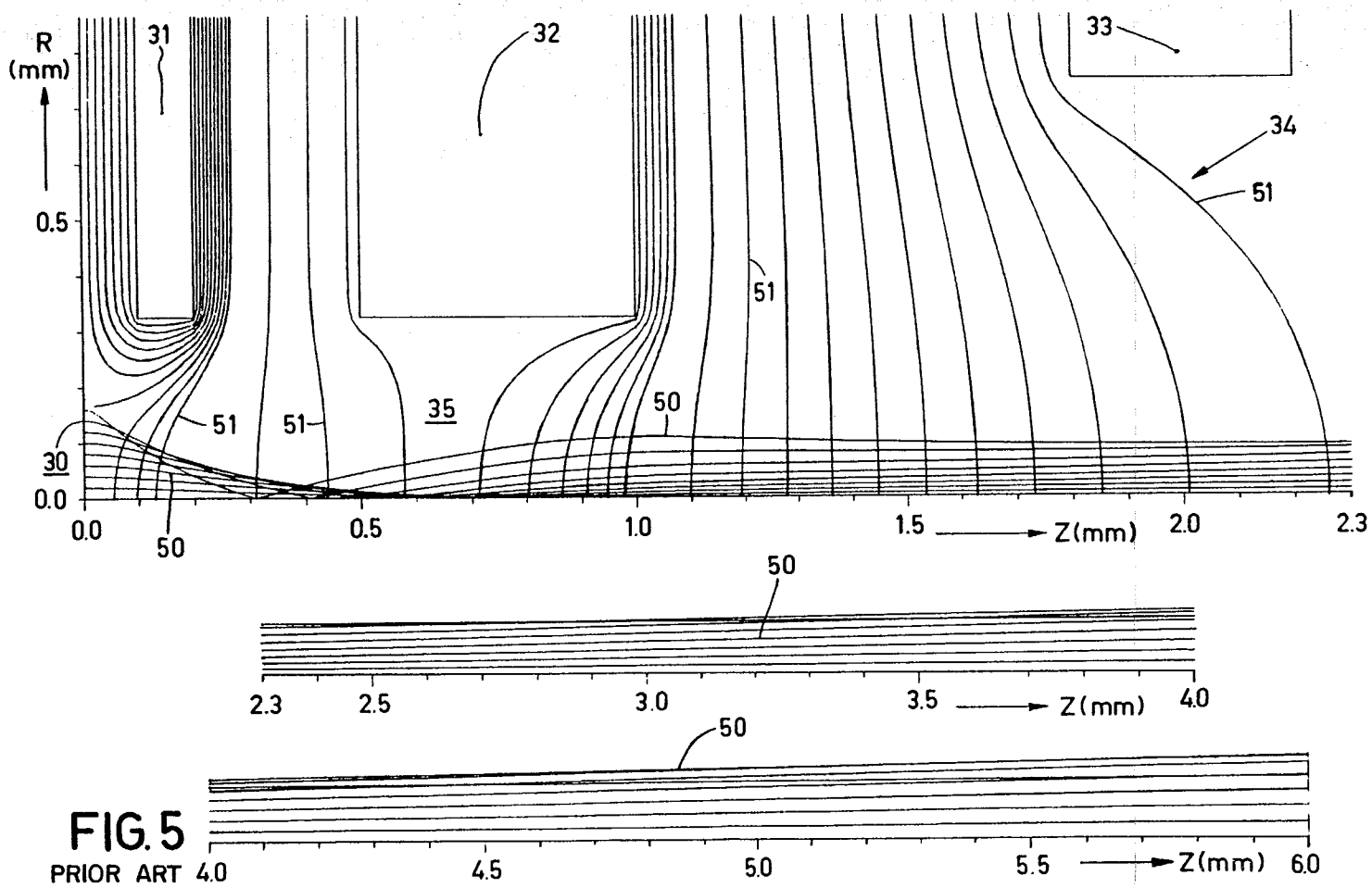
FIG. 5 PRIOR ART
Figure 6:
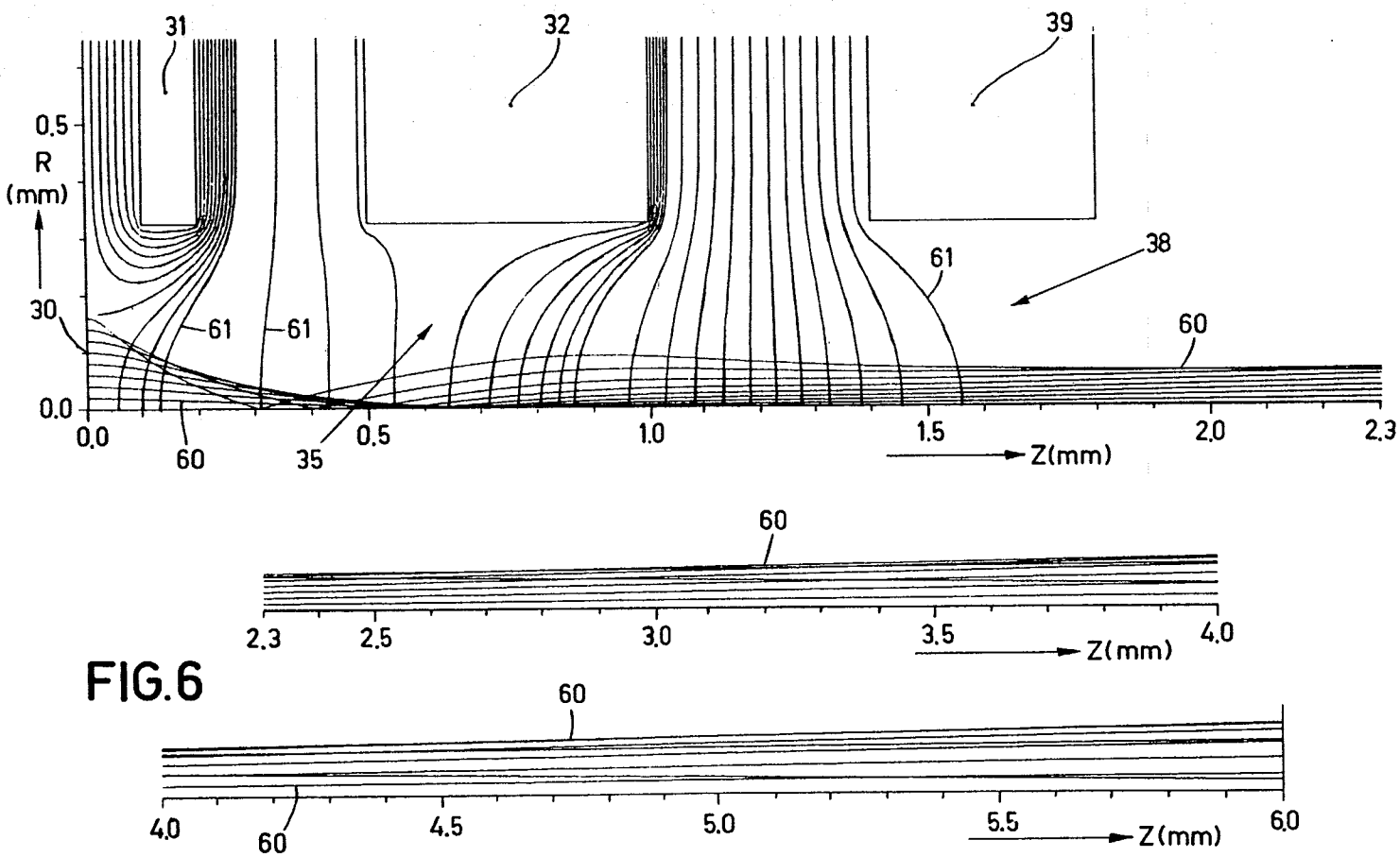

In the FIG. 6 electron gun considerably more edge rays are bent further into the beam than in the FIG. 5 electron gun.

Figure 7A:
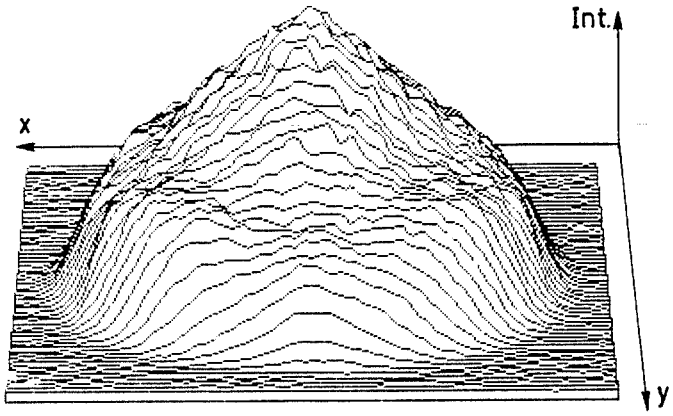
FIG. 7a PRIOR ART
FIGS. 7*a* and 7*b* show the measured intensity distribution in a spot obtained in a prior art cathode-ray tube, and finally.
Figure 7B:
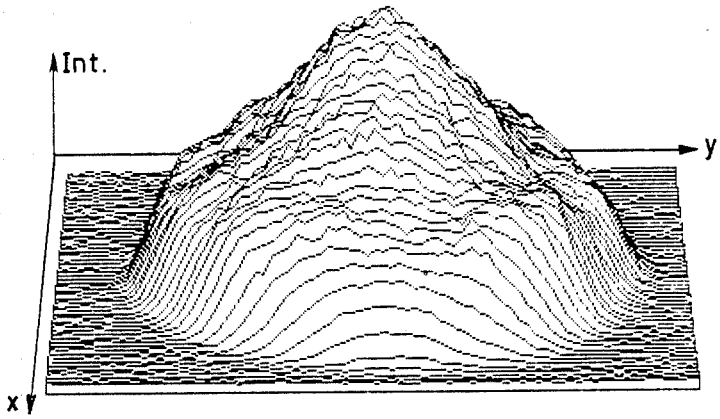
FIG. 7b PRIOR ART
Figure 8A:
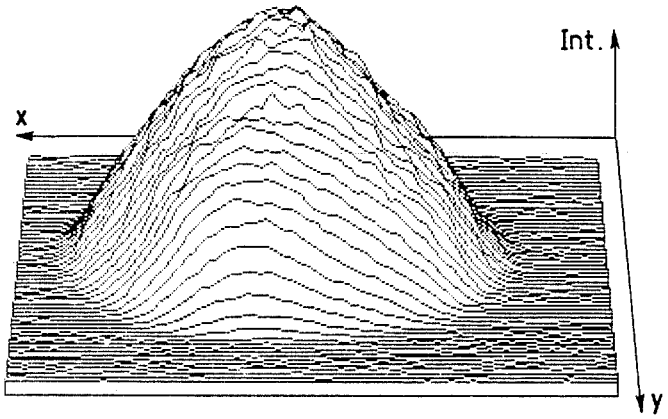
FIGS. 8*a* and 8*b* show the measured intensity distribution in a spot obtained in a cathode-ray tube in accordance with the invention.
Figure 8B:
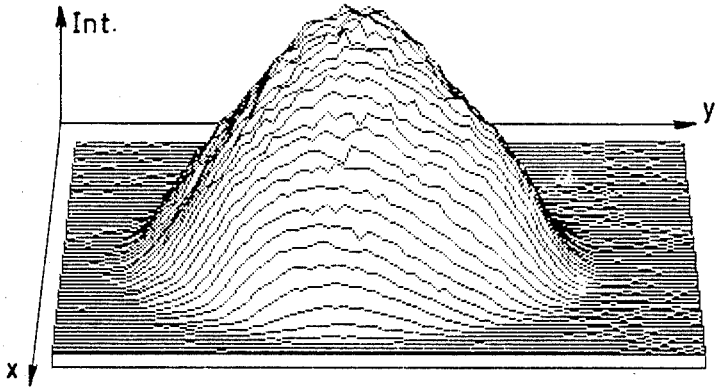

FIGS. 7*a* and 7*b* show from two mutually perpendicular directions a measured intensity distribution in a spot on a display screen of a prior art electron gun. FIGS. 8*a* and 8*b* show in an analogous manner a measured intensity distribution in a spot of an electron gun according to the invention. Comparison of FIGS. 7*a* and 8*a* and FIGS. 7*b* and 8*b* shows that the spot quality of an electron gun according to the invention is considerably better than of a prior art electron gun.

What is claimed is:

1. A cathode-ray tube comprising an envelope containing a luminescent screen and an electron gun for producing an electron beam propagating along a longitudinal axis of the tube to the screen, said electron gun including, in order along the direction of propagation of the electron beam, a plurality of electrodes having respective electron-beam-passing apertures including:

(a) a control gate and a first lens electrode defining, during operation, a first lens for forming the electron beam into a crossover;

(b) a second lens electrode which together with the first lens electrode defines, during operation, a second lens for accelerating the electron beam and pre-focusing the electron beam crossover; and (c) at least a third lens electrode which together with the second lens electrode defines during operation, a third lens for focusing the electron beam crossover into a spot on the screen;

characterized in that said first and second lens electrodes are spaced apart and have their respective apertures centered on the axis, the aperture in the second lens electrode having a diameter smaller than twice that of the first lens electrode, and the effective spacing S-eff between said first and second lens electrodes being smaller than 1 mm., S-eff being defined as the minimum of the function $-\Delta V/E(z)$, where $\Delta V$ is the difference between predefined operating voltages of the first and second lens electrodes, and where $E(z)$ is the electrical field strength on the axis between the first and second lens electrodes as a function of the distance z along the axis, the effective spacing S-eff being larger than the geometrical spacing between the first and second lens electrodes.

2. A cathode-ray tube as in claim 1 where the geometrical spacing between the second lens electrode and the first lens electrode is smaller than 0.8 mm.

3. A cathode-ray tube as in claim 1 where the diameter of the aperture in the first lens electrode is smaller than 0.9 mm and the diameter of the aperture in the second lens electrode is smaller than 1.6 mm.

4. A cathode-ray tube as in claim 1 where the diameter of the aperture in the second lens electrode is approximately equal to the diameter of the aperture in the first lens electrode.

5. A cathode-ray tube as in claim 1 where the geometrical spacing between the first and the second lens electrodes is approximately equal to 0.4 mm.

* * * * *